United States Patent [19]

Guiseppi-Elie et al.

[11] Patent Number: 4,499,007

[45] Date of Patent: Feb. 12, 1985

[54] STABILIZATION OF CONDUCTIVE POLYMERS IN AQUEOUS ENVIRONMENTS

[75] Inventors: Anthony Guiseppi-Elie, Cambridge; Gary E. Wnek, Natick, both of Mass.

[73] Assignee: Massachusetts Institute of Technology, Cambrige, Mass.

[21] Appl. No.: 449,028

[22] Filed: Dec. 13, 1982

[51] Int. Cl.[3] ..... H01B 1/06

[52] U.S. Cl. ..... 252/500; 526/285; 525/355; 525/356

[58] Field of Search ..... 252/500, 518; 526/285; 525/355, 356

[56] References Cited

U.S. PATENT DOCUMENTS 4,222,903 9/1980 Heeger et al. ..... 252/518

*Primary Examiner*—Josephine Barr

*Attorney, Agent, or Firm*—Arthur A. Smith, Jr.; Thomas J. Engellenner

[57] ABSTRACT

Polyacetylene, doped with iodine, can be stabilized against aqueous deterioration by immersion in moderately concentrated chloride solutions.

4 Claims, 1 Drawing Figure

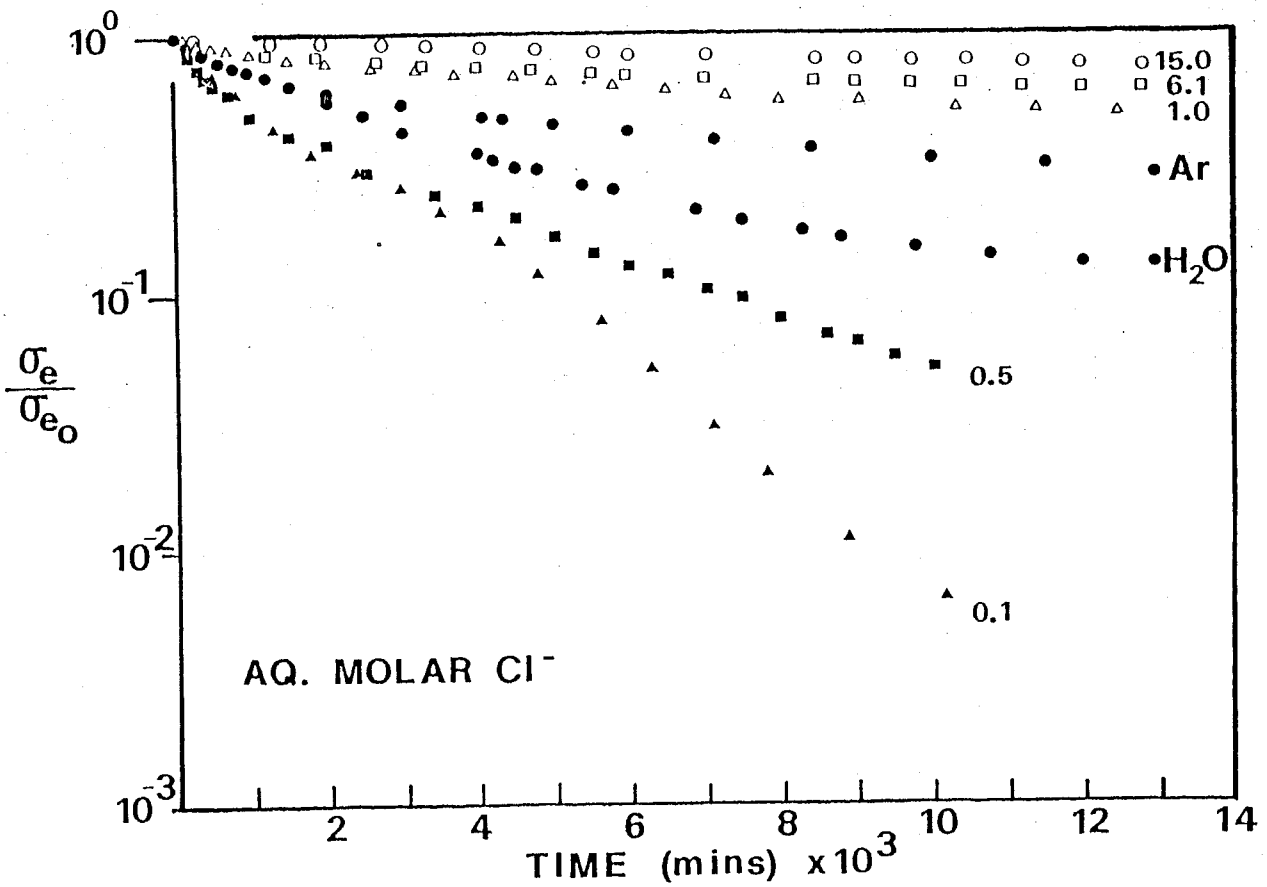
15.0
6.1
1.0
Ar
$H_2O$
0.5
0.1
AQ. MOLAR $Cl^-$
$10^0$
$10^{-1}$
$10^{-2}$
$10^{-3}$
$\frac{\sigma_e}{\sigma_{e_o}}$
2
4
6
8
10
12
14
TIME (mins) x$10^3$

STABILIZATION OF CONDUCTIVE POLYMERS IN AQUEOUS ENVIRONMENTS

The U.S. Government has rights in this invention pursuant to Grant Number 78-24185 DMR awarded by the National Science Foundation.

TECHNICAL FIELD

This invention relates to conductive polymers and, in particular, to stabilization of conductive polyacetylene.

BACKGROUND OF THE INVENTION

Polyacetylene, $(CH)_x$, is a material which has become the focus of considerable interest because of its capacity to be rendered highly conductive by treatment with a variety of electron acceptor and donor 'dopants'. The light weight and potential low cost associated with this polymeric material when combined with this novel property, high conductivity, suggests that it may be exploited in a variety of technological applications. Indeed, working p-n junctions, lightweight rechargable storage batteries and cells for photoenergy conversion have been constructed from this material. For a description of doped polyacetylene materials and their uses, see U.S. Pat. No. 4,222,903 issued to Heeger et al. on Sept. 16, 1980, the teachings of which are herein incorporated by reference.

Unfortunately, polyacetylene suffers from a number of limitations with regard to its practical application. The principal problem addressed herein is the tendency of doped polyacetylene to lose its conductivity in the presence of moisture.

Prior art techniques for the stabilizing polyacetylene typically involve coating the material with a layer of wax or another polymer. The processes described to date work by excluding the reactive elements of the environment, oxygen and moisture. These processes therefore work by conferring to the doped polyacetylene the barrier properties of the second material. In this regard they have only the capacity to sustain observed properties. In no case known is the resulting property improved over that which can be sustained under inert conditions (under argon, nitrogen or other inert gas) or under vacuum.

It is important to point out that oxygen and water are believed to act as aggressive agents for doped polyacetylene by two different mechanisms. Oxygen literally oxidizes the polymer backbone to structures which can no longer sustain the transport of charge and consequently a decay in the conductivity is observed. Water on the other hand, is thought to react directly with the charge carriers as follows:

$$R^{+}+H_2O=R{-}OH+H^{+}$$

Where $R^+$ is a carbenium ion and is representative of doped, p-type $(CH)_x$.

The present interest in conductive polymers is due in large measure to their applications in batteries. Water would be highly desirable as an electrolyte medium in such applications due to its obvious low cost and nontoxicity. Therefore, successful attempts at delaying the deteriorating effects of water on the conductivity of doped, p-type $(CH)_x$ would be of general interest.

SUMMARY OF THE INVENTION

It has been discovered that conductive polyacetylene, doped with iodine can be stabilized against aqueous deterioration by immersion in moderate to concentrated chloride solutions. So long as the aqueous enviroment is also deaerated, protection against oxidation is also provided. The invention is well suited for sealed aqueous environments such as batteries.

Our discovery is unexpected because it previously was thought that the optimal stability for conductive polymers resided in an inert gaseous environment, such as argon and that any aqueous environment, even distilled, deoxygenated water, would be detrimental. Experiments showed that argon was indeed preferred over pure water but, unexpectedly, moderate to high concentration chloride solutions achieved better stability than either deoxygenated water or argon.

Preferably, the chloride concentrations should be greater than 0.5 molar and most preferably, the solutions should be 1.0 molar or more. The stabilizing effect has been demonstrated for chloride solutions up to 15.0 molar. Various chloride salts may be employed to form the ionic solutions.

Our invention will next be described below in connection with various examples; however, it should be obvious to those skilled in the art that various changes and modifications can be made without departing from the spirit or scope of my claims. For example, the polyacetylene itself may be synthesized by a variety of known methods and may take the form of films or strips or may be incorporated into a polymer blend.

DETAILED DESCRIPTION OF THE PREFERRED EMBODIMENTS

Cis-Polyacetylene films were prepared at −78° C. using the technique described in Shirakawa et al. Vol. 4 *Synthetic Metals,* p. 43 (1981) herein incorporated by reference. Elemental analyses of the as-synthesized pristine polymers indicated CH contents of >99%. Iodine doping was achieved by exposing the pristine polymer to a vapour stream of iodine carried in deoxygenated and dried argon. The doped polymer was subsequently subjected to a dynamic vacuum ($10^{-5}$ torr) for 24 hours to remove adsorbed iodine. Elemental analyses of the resulting doped polymers produced compositions in the range $(CHI_{0.18-0.20})_x$ and were in good agreement with simultaneously determined compositions via weight uptake. The resulting room temperature four-probe conductivities were in the range 200–300 $\Omega^{-1}$ $cm^{-1}$.

The conductivities of the doped films were followed as a function of exposure time under argon, in deaerated, deionized, distilled water and in aqueous solutions of analytical grade NaI, NaSCN, NaBr and NaCl made from water of similar high quality. For the immersion exposure experiments, samples were mounted in a dry box onto four-probe platinum electrodes using Electrodag 502 and the leads individually sealed with Microstop Stopoff Lacquer. This latter step was done to insure that the electrical conductivity of the doped $(CH)_x$ was exclusively measured without ionic contributions from the electrolyte solutions. The mounted films were quickly transferred to 250 ml three neck flasks containing the desired deaerated, aqueous solution. The solutions were blanketed with argon throughout the duration of the experiment (approximately nine days).

In FIG. 1 are plotted the normalized conductivities ($\sigma e/\sigma_{e\,o}$, where $\sigma_{e\,o}$ is the initial conductivity; the subscript e is used to emphasize that it is the electronic conductivity of the film which is being measured) of iodine-doped $(CH)_x$ film in argon, water and aqueous solutions of various concentrations of $Cl^-$. The highest concentration, 15.0 M, was obtained as a saturated solution of LiCl; all other solutions were of NaCl. Several points are noteworthy. The conductivity of the doped film decays under rigorously purified argon, falling to 27% of its initial value over the nine day period. This phenomenon has been observed by other workers and has been attributed to slow iodination of the $(CH)_x$ backbone. It can be also seen from FIG. 1 that immersion in water affords a more rapid decay of the conductivity, falling to 13% of its initial value over the nine day period. This presumably results from the consumption of carbenium ions (charge carriers).

The remaining curves of FIG. 1 display the stability performance of iodine-doped polyacetylene in aqueous solutions of varying concentrations of NaCl. The 0.10 M NaCl solution is more aggressive than distilled water, presumably because $Cl^-$ is a better nucleophile than water. However, the 0.50 M NaCl solution, while still more aggressive than water affords less a conductivity decay than the 0.10 M solution. Most significant is the observation that solutions of 1.00 M or greater afford improved stability compared with water and, interestingly, argon. We have made a preliminary survey of concentrated solutions of other nucleophiles, ($SCN^-$, $I^-$ and $Br^-$). It was found that all of these solutions were more aggressive than water itself. Furthermore, the magnitude of the conductivity decay appeared to be in the approximate order of the strength of the nucleophiles ($SCN^- > I^- > Br^- > Cl^- > H_2O$) with the notable exception being the Cl ion as previously discussed.

The origin of this enhanced stability in concentrated chloride solutions is not clear. A possible explanation resides in the formation of the non-reactive interhalide, $I_2Cl^-$, the result of the reaction of molecular iodine (decomposed $I_3^-$ or adsorbed $I_2$) and chloride ions. The iodine so consumed would no longer be available for reaction with the $(CH)_x$ backbone, thus accounting for the improved stability over that found under argon.

What we claim is:

1. A method of stabilizing iodine-doped, conductive polyacetylene in a deaerated aqueous solution comprising the step of introducing into the aqueous solution a source of chloride ions to produce a chloride ion concentration greater than 0.5 molar.

2. The method of claim 1 wherein the step of introducing chloride ions into solution further comprises the step of producing a chloride ion concentration of about 1.0 molar or greater.

3. A conductive polymer system comprising:

(a) a conductive, iodine-doped polyacetylene; and (b) a deaerated aqueous environment containing a concentration greater than 0.5 molar of chloride ions in solution.

4. The system of claim 3 wherein the concentration of chloride ions is greater than 1.0 molar.

* * * * *